United States Patent [19]

Fery

[11] Patent Number: 4,567,982

[45] Date of Patent: Feb. 4, 1986

[54] MAILER CONSTRUCTION

[75] Inventor: Guy A. Fery, New York, N.Y.

[73] Assignee: Floating Sky, Inc., New York, N.Y.

[21] Appl. No.: 449,361

[22] Filed: Dec. 13, 1982

Related U.S. Application Data

[63] Continuation-in-part of Ser. No. 346,441, Feb. 8, 1982, Pat. No. 4,434,889.

[51] Int. Cl.[3] ..... B65D 77/00; B65D 73/00; B65D 75/20; B65D 65/10

[52] U.S. Cl. ..... 206/216; 206/232; 206/492; 206/494; 229/87.5; 229/92

[58] Field of Search ..... 206/496, 806, 492, 216, 206/232, 315, 494, 449, 425; 229/9, 19, 40, 87.5, 87 A, 92

[56] References Cited

U.S. PATENT DOCUMENTS

| | | | |
|---|---|---|---|
| 295,098 | 3/1884 | Bauer | 229/9 |
| 778,053 | 12/1904 | Lindsley | 229/87.5 |
| 1,109,162 | 9/1914 | Claussen | 206/494 |
| 1,364,556 | 1/1921 | Hurff | 206/496 |
| 1,424,836 | 8/1922 | Lorer | 206/216 |
| 1,721,615 | 7/1929 | Cook | 206/494 |
| 1,766,006 | 6/1930 | Tees | 206/232 |
| 1,774,215 | 8/1930 | Weinthrop | 229/87.5 |
| 2,410,858 | 11/1946 | Auger | 229/87.5 |
| 2,799,391 | 7/1957 | Eisner | 206/232 |
| 2,917,164 | 12/1959 | Kehr | 206/232 |
| 3,089,586 | 5/1963 | Cole | 206/216 |
| 3,285,402 | 11/1966 | Gordun | 226/40 |
| 3,333,686 | 8/1967 | Schrabel | 206/806 |
| 4,186,868 | 2/1980 | Coleman | 206/492 |
| 4,328,895 | 5/1982 | Jaeger | 206/496 |

FOREIGN PATENT DOCUMENTS

| | | | |
|---|---|---|---|
| 152736 | 5/1932 | Switzerland | 206/216 |
| 14347 | of 1911 | United Kingdom | 229/92 |

*Primary Examiner*—William T. Dixson, Jr.
*Assistant Examiner*—Brenda J. Ehrhardt
*Attorney, Agent, or Firm*—Wolder, Gross & Yavner

[57] ABSTRACT

A mailer construction includes a receptacle bound or otherwise affixed to a single or multi-page envelope or printing. The receptacle forms either the cover or outer surfaces of the mailer, or may be retained within the envelope or pages. The receptacle is removable from the remainder of the assembly, and can be opened and used after the remainder of the assembly is discarded. The receptacle may have appropriate printed indicia upon its sides.

8 Claims, 25 Drawing Figures

FIG. 1
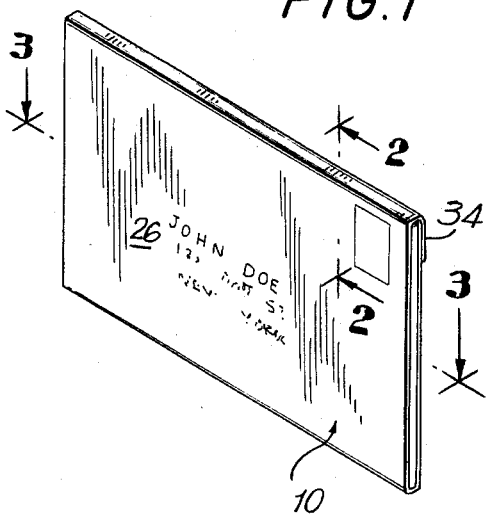
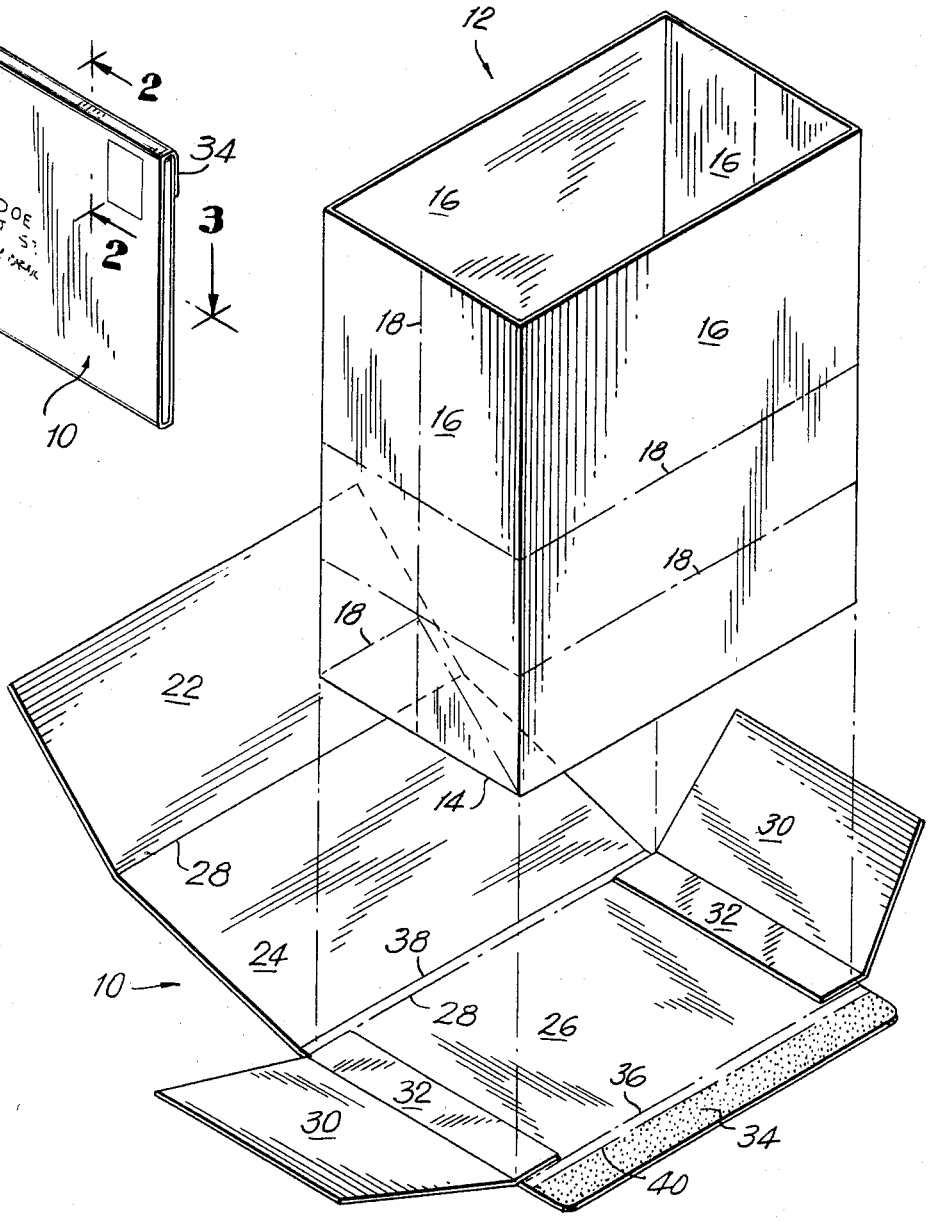
FIG. 4
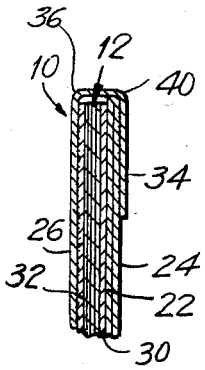
FIG. 2
FIG. 3
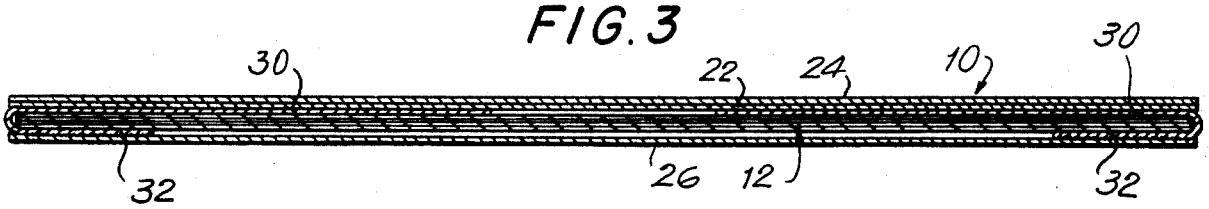

FIG. 5
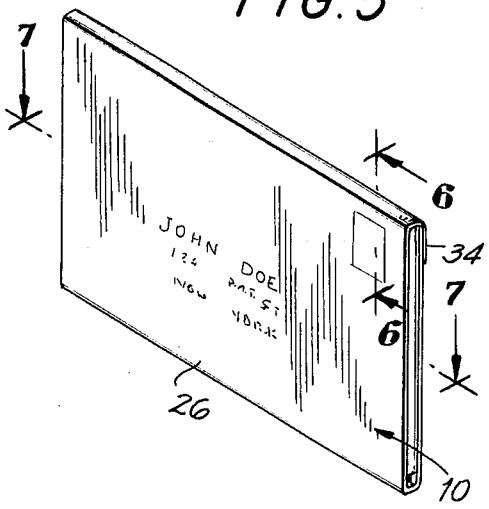
FIG. 6
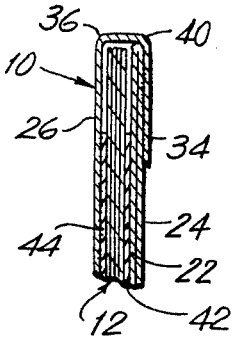
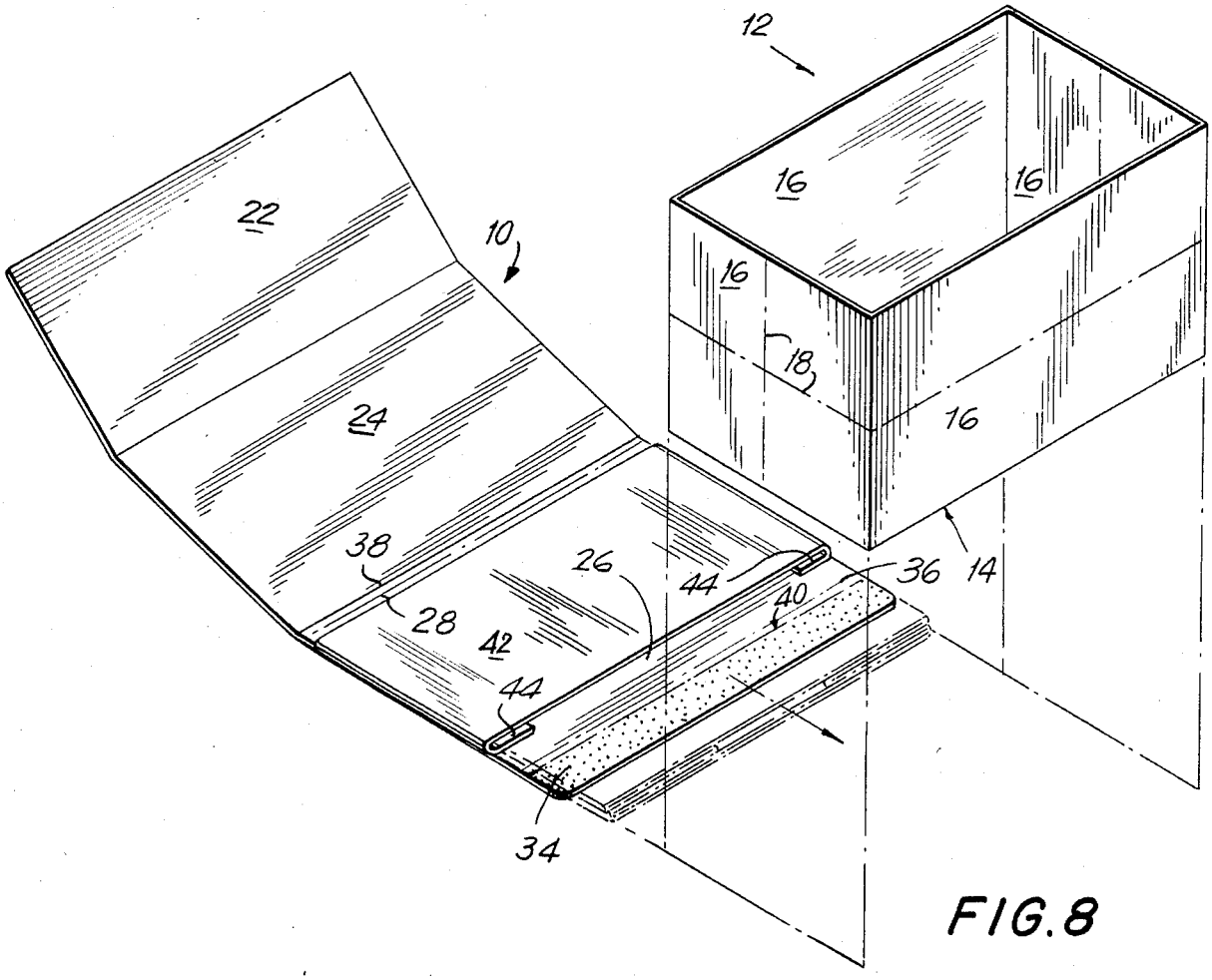
FIG. 8
FIG. 7
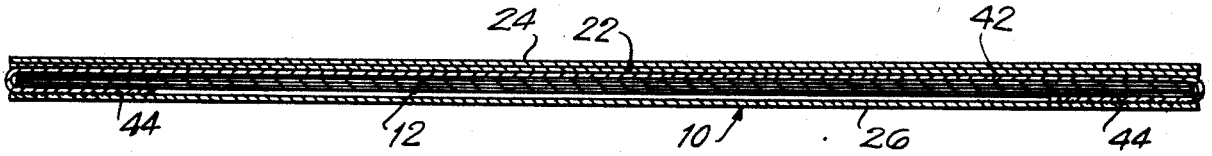

FIG. 9
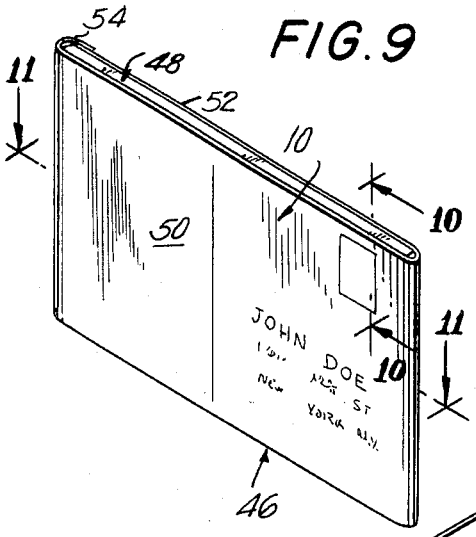
FIG. 10
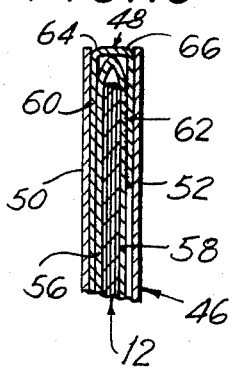
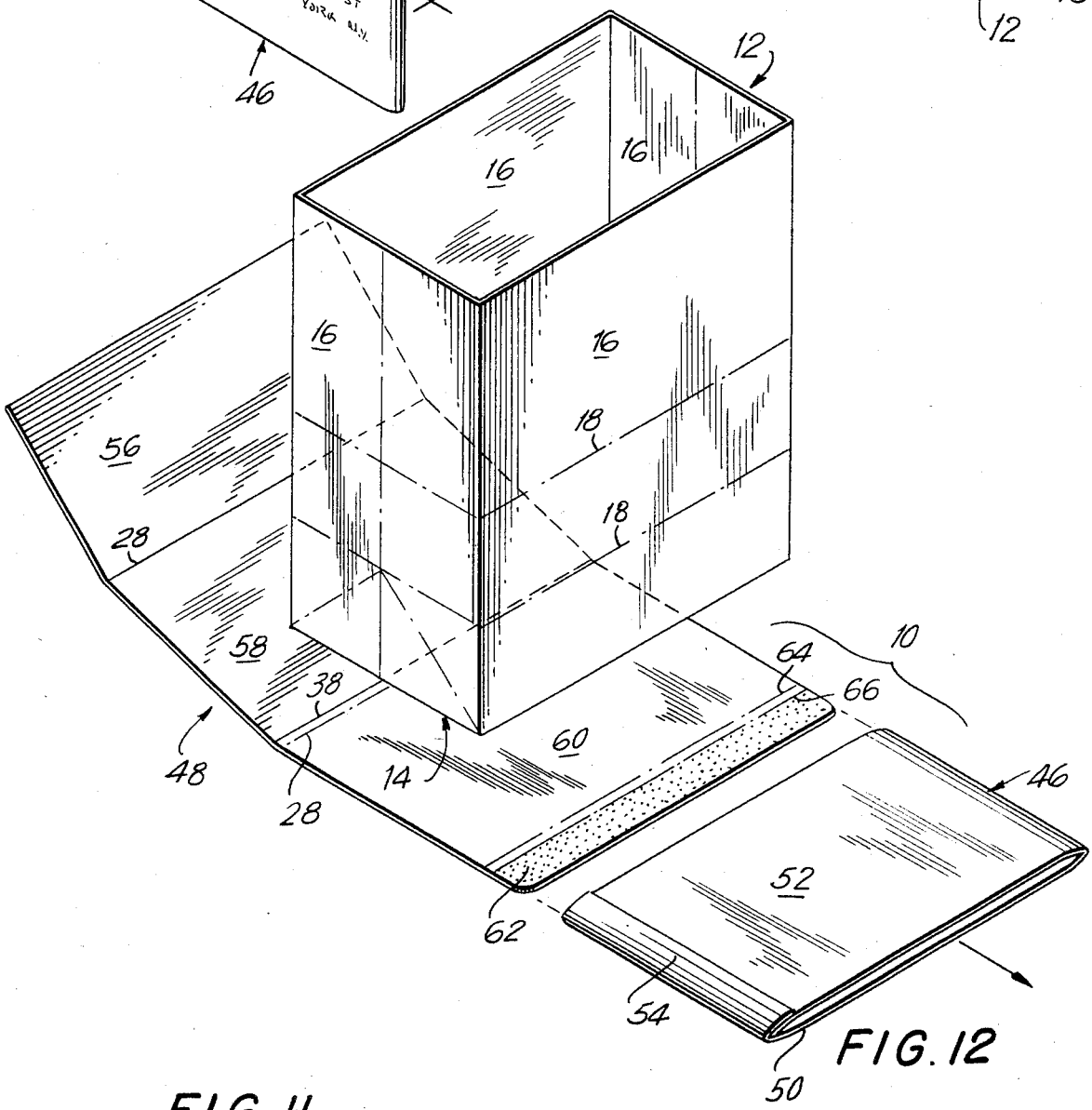
FIG. 12
FIG. 11
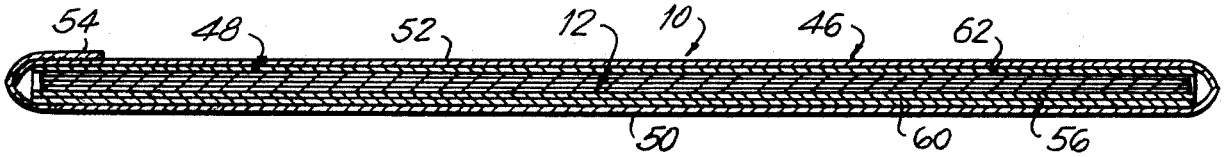

FIG. 13
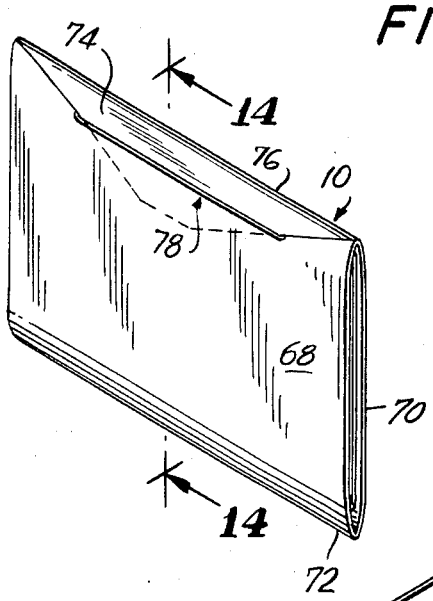
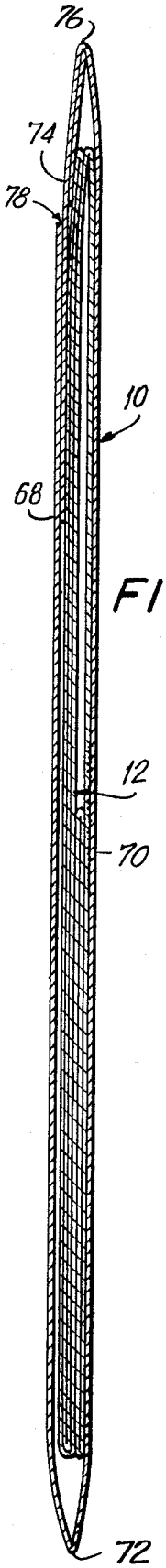
FIG. 14
FIG. 15
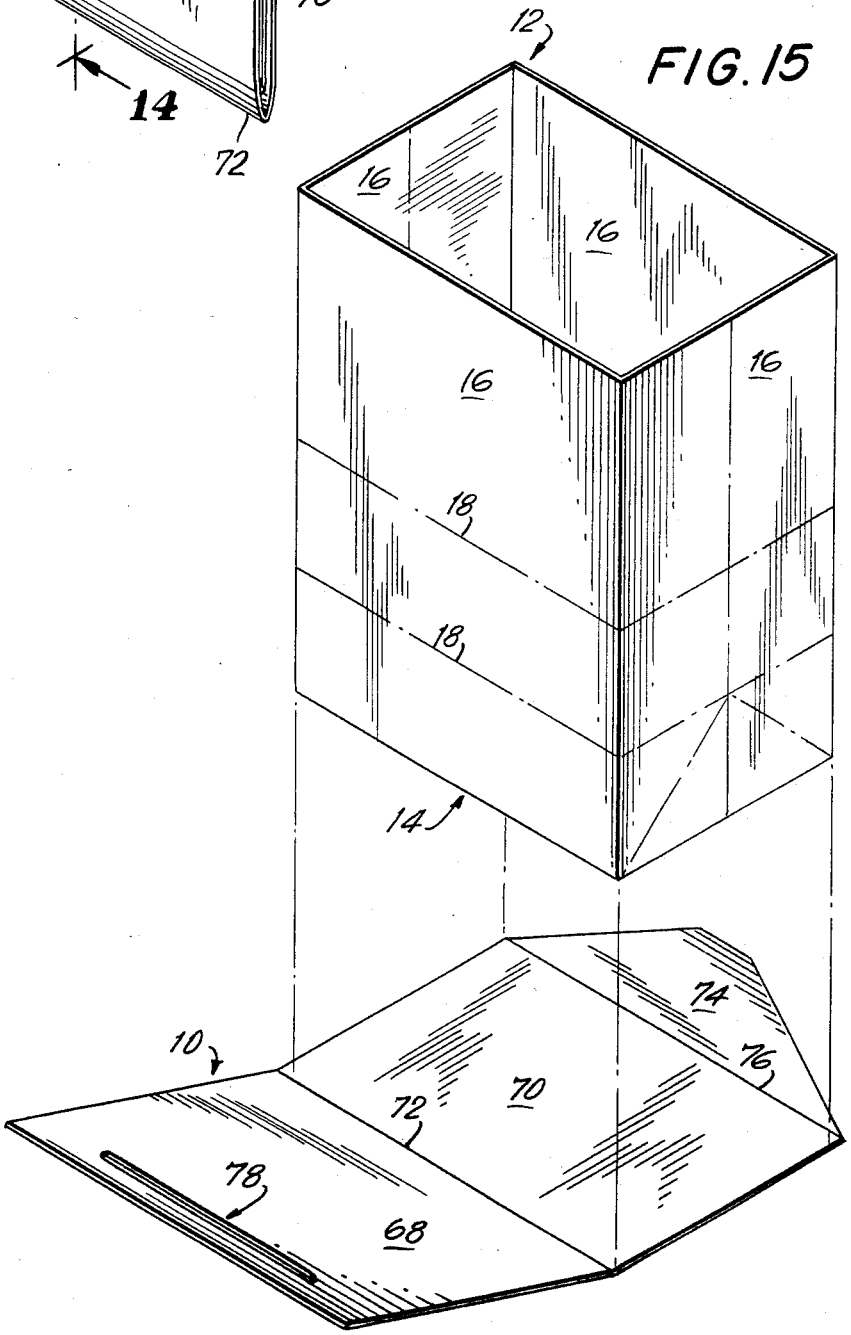

FIG. 16
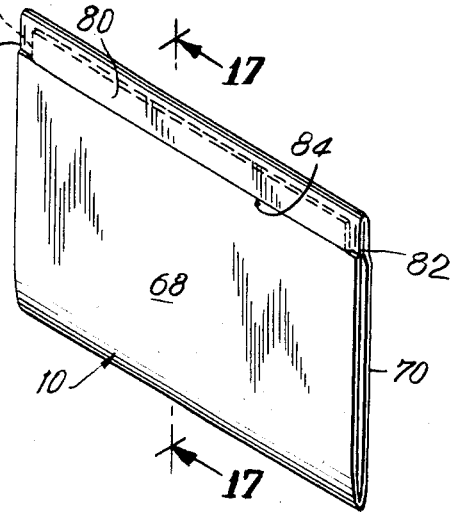
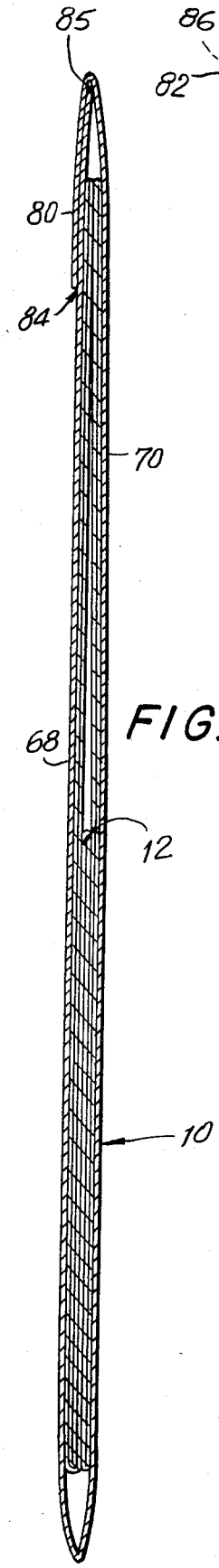
FIG. 17
FIG. 18
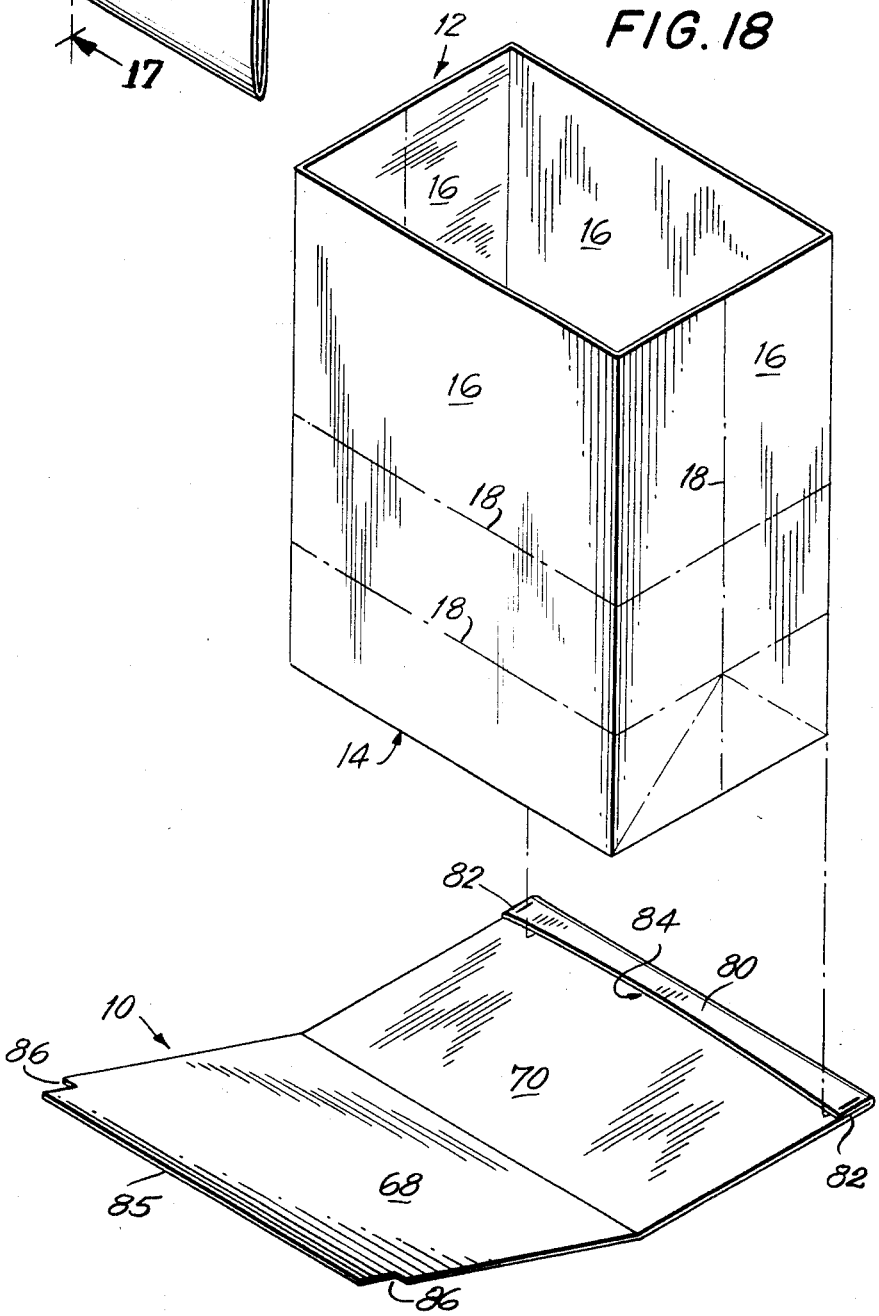

FIG. 19
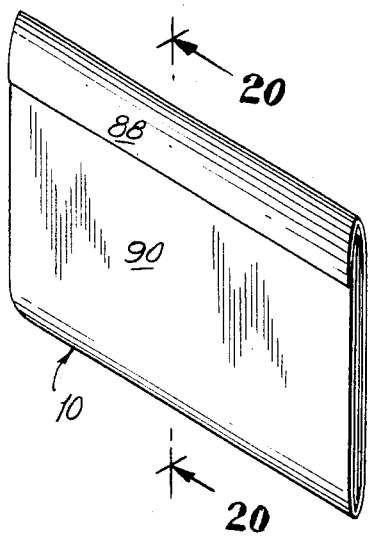
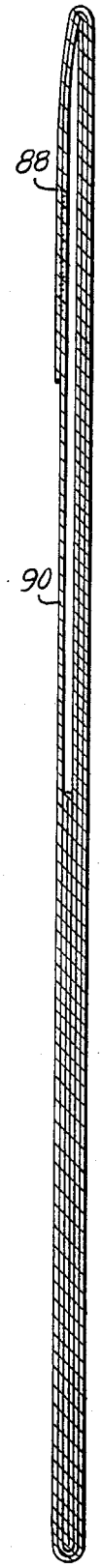
FIG. 20
FIG. 21
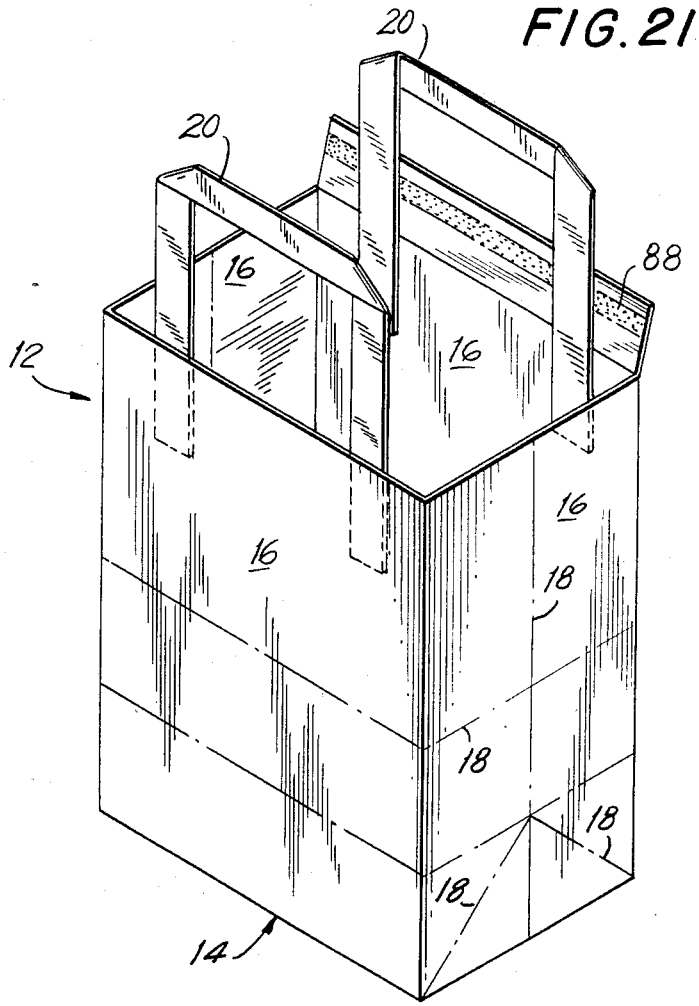

FIG. 22
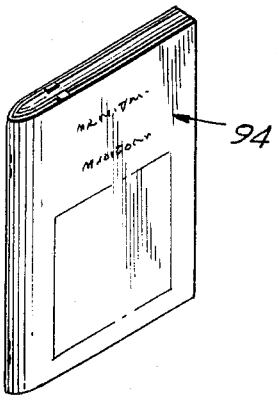
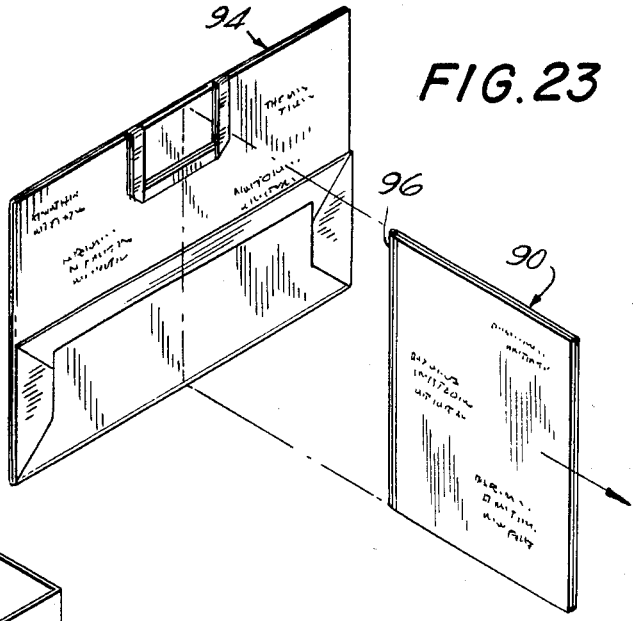
FIG. 23
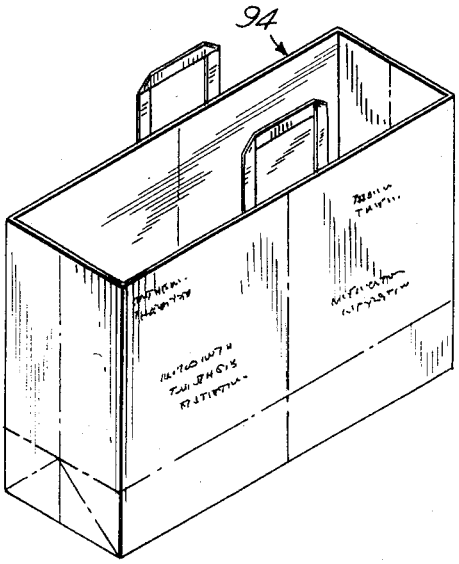
FIG. 24
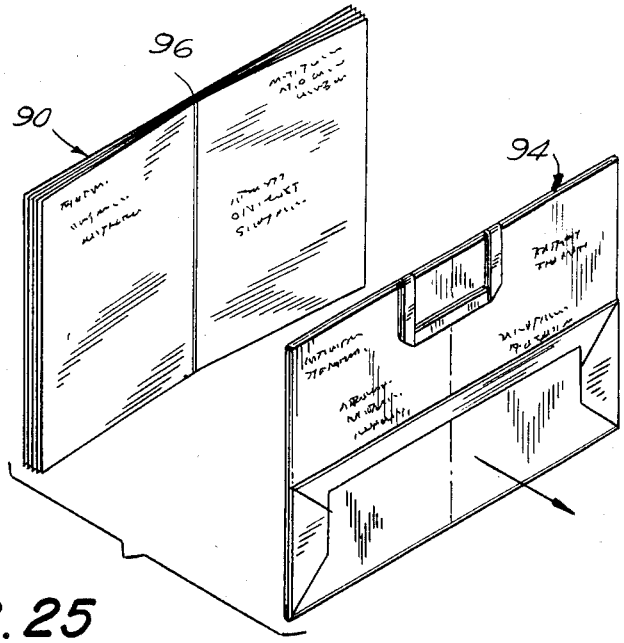
FIG. 25

MAILER CONSTRUCTION

The present application is a continuation-in-part of application Ser. No. 346,441 filed Feb. 8, 1982 now U.S. Pat. No. 4,434,889.

BACKGROUND OF THE INVENTION

The present invention relates to a card, envelope, mailer, multi-page document or other type of printed matter and, in particular, to such a formed paper or other sheet material which construction includes as a part thereof a collapsible container or receptacle which may be opened by the recipient and used in the appropriate manner as well as an information or message-imparting section.

A typical letter, mailer, magazine, flyer, or card, while indicating to the recipient the concerns, thoughts and interests of the sender, is a device of limited practicality. Soon after receipt by the recipient the construction is often discarded, its message and contents having been duly received and noted by the person whom it was sent.

In addition, promotional and informational material mailed or offered for sale in the form of printed matter needs to have an element of attractiveness or novelty to grasp the recipient's attention so that the material being presented or offered for the recipient's consideration will be noticed. A utilitarian object, which may be retained and utilized by the recipient for a period of time after receipt can serve this function and can be further adorned with appropriate indicia to further promote the services or products of the sender.

It is therefore an object of the present invention to provide a mailer or similar sheet material construction which includes an integral receptacle which may be removed from the mailer and be used in a utilitarian sense and which extends the useful life of the construction. The receptacle may be adorned with further informational promotional indicia.

In co-pending application Ser. No. 346,441 a greeting card construction is disclosed in which a receptacle is affixed to the mailer to provide the utilitarian feature. In accordance with the present invention that concept is further developed to provide sheet material constructions of varied forms including as a part thereof a folded paper or other flexible sheet-like material container. The container is so dimensioned as to be foldable to a size compatible with the dimensions of the sheet material construction, and is removable affixed to the construction. Surfaces of the construction are provided for addressing, promotion, and/or communication of the appropriate message information. The foldable container or receptacle itself may be provided with appropriate indicia to coordinate and further reinforce the tenor of the construction. The receptacle may be formed as the cover or outer surfaces of the mailer, or may be located or bound within the construction.

BRIEF DESCRIPTION OF THE DRAWINGS

A complete understanding of the present invention, as well as further objects and features thereof, can be obtained by reference to the following description of preferred, but nonetheless illustrative embodiments of the present invention when taken in conjunction with the annexed drawings, wherein:

FIG. 1 is a perspective view of a first embodiment of the invention showing an envelope construction with enclosed receptacle in the closed, ready for mailing configuration;

FIG. 2 is a partial sectional view taken along line 2—2 of FIG. 1;

FIG. 3 is a sectional view taken along line 3—3 of FIG. 1;

FIG. 4 is an exploded perspective view of the embodiment of FIGS. 1-3 showing the alignment of the receptacle and overlying envelope construction;

FIG. 5 is a perspective view of a second embodiment of the invention showing an envelope construction having an integral inner retention panel and enclosed receptacle in the closed, ready for mailing configuration;

FIG. 6 is partial sectional view taken along line 6—6 of FIG. 5;

FIG. 7 is a sectional view taken along line 7—7 of FIG. 5;

FIG. 8 is an exploded perspective view of the embodiment of FIGS. 5-7 showing the alignment of the receptacle and overlying envelope and retention panel construction;

FIG. 9 is a perspective view of a third embodiment of the invention showing a two-part envelope construction and enclosed receptacle in the closed, ready for mailing configuration;

FIG. 10 is a partial sectional view taken along line 10—10 of FIG. 9;

FIG. 11 is a sectional view taken along line 11—11 of FIG. 9;

FIG. 12 is an exploded perspective view of the embodiment of FIGS. 9-11 showing the inner envelope retention section and the receptacle having been removed therefrom;

FIG. 13 is a perspective view of a fourth embodiment of the invention showing yet another envelope construction with the enclosed receptacle in the closed, ready for mailing, configuration;

FIG. 14 is a sectional view taken along line 14—14 of FIG. 13;

FIG. 15 is an exploded perspective view of the embodiment of FIGS. 13 and 14;

FIG. 16 is a perspective view of a fifth embodiment of the invention showing a further envelope construction with an integral inner securance flap or pouch and enclosed receptacle in the closed, ready for mailing configuration;

FIG. 17 is a sectional view taken along line 17—17 of FIG. 16;

FIG. 18 is an exploded perspective view of the embodiment of FIGS. 16 and 17;

FIG. 19 is a perspective view of a sixth embodiment of the invention showing another envelope construction in which a portion of the receptacle defines an outer surface of the envelope;

FIG. 20 is a sectional view taken along line 20—20 of FIG. 19;

FIG. 21 is a perspective view of the embodiment of FIGS. 19-20 showing the receptacle in the open position;

FIG. 22 is a perspective view of yet another embodiment of the invention in which the receptacle is formed as a cover of a multi-page print item;

FIG. 23 is a perspective view of the receptacle of FIG. 22 removed from the print item;

FIG. 24 is the receptacle in the open configuration; and

FIG. 25 is an alternative embodiment of the embodiment of FIG. 22–24 in which the receptacle is mounted among the pages of the print item.

DESCRIPTION OF THE PREFERRED EMBODIMENTS

Referring intially to FIGS. 1–21, the present invention may take the general form of an envelope 10 and enclosed receptacle 12. Bother envelope 10 and receptacle 12 are manufactured of appropriate sheet material, with envelope 10 normally being of a paper or cardboard product and receptacle 12 being of craft paper or light gauge plastic.

In general, receptacle 12 includes a generally flat base 14 and upstanding sides 16, which are provided with appropriate fold lines 18 to allow the container to be collasped to the essentially planar folded state. Handles 20, as may be seen in the embodiment of FIG. 21, may be constructed of a heavy gauge paper, may be provided at the top of the receptacle, and may be folded inwardly when the receptacle is in the collapsed position.

As seen in FIGS. 1–4, envelope 10 may include first message panel 22, middle panel 24, and third address panel 26, joined seratim along their widths by fold lines 28, which may be perforated, scored or otherwise provided. Affixed to opposed edges of third panel 26 are receptacle retention flaps 30 having affixation tabs 32 secured to the panel. Third panel 26 is further provided with sealing flap 34 joined thereto by fold line 36 and provided with an appropriate moisture-activated adhesive to secure the envelope in the folded configuration shown in FIG. 1. The dimension of the panels are such that message panel 22 may be folded inward to overlay the inner face of address panel 24 and both panels may be again folded inward to overlay the folded receptacle 12.

The dimension of receptacle 16 and in particular of its base 14, are such that it can overlie the inner face of third panel 26 when folded. Flaps 30 are then folded inward over the folded receptacle, and the flap comprised of panels 22 and 24 is then folded to overlie the receptacle. Flap 34 is then moistened and folded over the edge of panel 22 to retain the entire assembly in the folded state. Depending upon the gauge of the materials used for the envelope and receptacle, auxiliary fold line 38 may be provided proximate to and parallel to fold line 28 between panels 24 and 26 on panel 24 to accomodate the thickness of the folded structure. A similar auxiliary fold line 40 may be provided on flap 34.

Both the inner and outer surfaces of the panels may be used in the appropriate manner to either transmit written and/or pictorial information. The construction can also be utilized to enclose further sheet material bearing other information or sentiments in the manner of a conventional envelope. The sides 16 of receptacle 12 can also be utilized for information display purposes.

Referring next to FIGS. 5–8, address panel 26 may be provided with a full width inner panel 42 having side tabs 44 affixed to the inner edges of address panel 26. Panel 42 and the inner surface of panel 26 define an open-ended sleeve which allows receptacle 12 to be slid therein when in the folded state. As in the previous embodiment, message panel 22 is folded inwardly upon panel 24, the resulting construction being folded over the inner face of panel 26 bearing inner panel 42 and enclosed receptacle 12. Sealing flap 34 keeps the construction in the folded state for mailing.

In the embodiment presented in FIGS. 9–12, envelope 10 is in the form of an external envelope sleeve 46 and an insert construction 48. Sleeve 46 has first side 50 and second side 52 constructed out of a unitary piece of material folded and bound together by flap 54. Dimensioned for insertion into the envelope sleeve is panel insert construction 48, comprising seratim panels 56, 58 and 60, each of which may bear printed or written information or correspondence. Panel 60 is supplied with an integral securement flap 62, with dual fold lines 64 and 65 providing sufficient clearance for the flap over the enclosed receptacle.

As in the previous embodiment panels 56, 58 and 60 are joined by fold lines 28 and 38 to accomodate the inserted receptacle assembly.

Referring next to FIGS. 13–15, in this embodiment envelope structure 10 includes first and second panels 68 and 70 joined by fold line 72. Envelope sealing flap 74 projects from panel 70 along fold line 76 while mating slot 78 is located in panel 68 to secure the flap 74 when the envelope is closed. The outside face of panel 70 may be used for address purposes while the inner faces of both panels 68 and 70 may be used for message bearing purposes. Receptacle 12 is dimensioned to fit within the closed panels in the similar manner as with previous embodiments. The receptacle may be affixed to one of the panels, if desired, by a peelable adhesive, such as rubber cement. Bothe fold lines 72 and 76 may have an auxiliary, parallel fold line (not shown) to accomodate the thickness of the enclosed folded receptacle.

In the embodiment presented in FIGS. 16–18, two panel envelope 10 is provided with inner flap 80 along the external edge of panel 70. Flap 80 is affixed to the panel 70 proximate its outer edges 82 to define a pocket 84 into which an edge of the collapsed receptacle 12 may be inserted. External edge 85 of panel 68 has corner section 86 removed to permit the panel edge to be inserted into pocket 84 to close the envelope assembly. As in the other embodiments, an external face of a panel 68 or 70 may be used for addressing purposes while the internal faces may be used for message correspondence.

The embodiment of FIGS. 19–21 depicts a construction in which the receptacle itself functions also as an envelope. In this embodiment receptacle 12 is provided with flap 88 on the upper edge of a side 16. The receptacle is folded upon itself such that the flap secures the bag in the folded position. The flap may be provided with a peelable adhesive, such as "rubber cement", to allow the receptacle to remain folded during transit and to be opened upon receipt. In this embodiment one of the outward facing surfaces of the bag, such as surface 90, is utilized as an address panel which internal surfaces may be used for correspondence. In addition, the receptacle may be used to carry additional sheets bearing written material.

As seen in the embodiments of FIGS. 22–25, the present invention may also be in the form of a multipage printed item 92 coupled to the folded receptacle 94. In this embodiment the receptacle, in its folded shape, duplicate the planar configuration of the individual sheets from which the pages of the printed item 92, such as catalog or magazine, are formed. The receptacle 94 may be in the form of an overlying cover for the printed item, as seen in FIG. 22 and 23, or may be bound within the leaves of the item, as shown in figure 25. In either case the receptacle is affixed to the printed item by staples or the like along the fold line 96 of the item sheets.

It is to be recognized that numerous modification and adaptation of the invention my be utilized without departing from the spirit of the invention. The scope of the invention, therefore, is to be measured by the annexed claims.

I claim:

1. A receptacle adapted and constructed to perform both a storage function and an information-transfer function, comprising a base and four upstanding sides, said base and sides being formed from a sheet material and being foldable into an essentially planar configuration, one of said sides having a tab located upon an edge dimensioned and adapted to be foldable over at least a portion of said receptacle when folded to retain said receptacle in said folded configuration, the sides and base of said receptacle being adapted to provide surfaces upon which an address and other information-transferring indicia may be placed.

2. A multi-page booklet construction, comprising a plurality of sheets formed into pages, said pages being bound to one another along a fold line to permit turning of the individual pages, and a receptacle having a base and upstanding sides formed from a sheet material and being foldable into an essentially planar configuration, said receptacle being bound in the planar configuration to said pages.

3. The construction of claim 2 wherein said receptacle serves as a cover for the pages of the booklet.

4. The construction of claim 2 wherein said receptacle is interleaved with the pages of the booklet.

5. The construction of claim 3 wherein said receptacle is bound to said pages along said fold line.

6. The construction of claim 4 wherein said receptacle is bound to said pages along said fold line.

7. A mailer construction comprising a receptacle having a base and upstanding sides, said receptacle being foldable into an essentially planar configuration and an envelope comprising three panels aligned seriatim by a series of fold lines therebetween, one of said panels having an inner panel affixed to a surface thereof along two opposed edges of said one panel as to form a pocket, said receptacle being further foldable to a planar size such that it is insertable into said pocket, said three panels being foldable such that said receptacle may be secured therebetween, each of said three panels being adapted to bear printed indicia on at least one surface thereof.

8. A mailer construction comprising a receptacle having a base and upstanding sides, said receptacle being foldable into an essentially planar configuration and an envelope comprising three panels aligned seriatim by a series of fold lines therebetween, said receptacle being further foldable to a planar size such that it is insertable between said three panels when in the folded configuration, and an outer sleeve member dimensioned to carry said envelope and receptacle, said sleeve member and each of said three panels being adapted to bear printed indicia on at least one surface thereof.

* * * * *